US005463456A

United States Patent [19]

Yashiki et al.

[11] Patent Number: 5,463,456

[45] Date of Patent: Oct. 31, 1995

[54] CLEANING ASSISTANT USED WITH A PHOTOSENSITIVE DRUM UNIT FOR LOWERING CHARGE MEMORY

[75] Inventors: Yuichi Yashiki; Masahiko Hodumi; Yuzuru Ohki; Takashi Ito; Fumitaka Nakjajima; Masakazu Mori; Takayoshi Aoki; Harumitsu Mizuishi; Yuusaku Shibuya, all of Minami-ashigara, Japan

[73] Assignee: Fuji Xerox Co., Ltd., Tokyo, Japan

[21] Appl. No.: 253,286

[22] Filed: Jun. 3, 1994

[30] Foreign Application Priority Data

Jun. 4, 1993 [JP] Japan ..... 5-158141
Feb. 2, 1994 [JP] Japan ..... 6-029180

[51] Int. Cl.[6] ..... G03G 21/00

[52] U.S. Cl. ..... 355/299; 118/652

[58] Field of Search ..... 355/200, 210, 355/211, 296, 299; 15/256.5, 256.51, 256.52, 1.51; 430/125; 118/652

[56] References Cited

U.S. PATENT DOCUMENTS 4,933,253 6/1990 Aoki et al. ..... 430/110
4,943,505 7/1990 Aoki et al. ..... 430/109

FOREIGN PATENT DOCUMENTS 60-186867 9/1985 Japan .
60-186876 9/1985 Japan .
64-70785 3/1989 Japan .

*Primary Examiner*—William J. Royer
*Attorney, Agent, or Firm*—Oliff & Berridge

[57] ABSTRACT

A photosensitive drum unit for an electrophotographic apparatus, of the type of contacting a cleaning blade to the photosensitive drum is disclosed, in which a cleaning assistant composed of a lubricant capable of lowering the frictionally charged potential of the photosensitive drum caused by the friction of the photosensitive drum and the cleaning blade to not higher than 100V is attached to the surface of the photosensitive drum, the cleaning blade or both.

4 Claims, 1 Drawing Sheet

CLEANING ASSISTANT USED WITH A PHOTOSENSITIVE DRUM UNIT FOR LOWERING CHARGE MEMORY

FIELD OF THE INVENTION

The invention relates to a photosensitive drum of an electrophotographic apparatus which is attached with a cleaning assistant for smoothing the rotation of the photosensitive drum of the electrophotographic apparatus when carrying out cleaning and recovering of toners remaining on the photosensitive drum by contacting a cleaning blade onto the photosensitive drum.

BACKGROUND OF THE INVENTION

In an ordinary electrophotographic process, a photosensitive drum of the electrophotographic apparatus is electrostatically charged and image-exposed to form latent images, the latent images are imagewise developed using toners, and after transferring the toner images onto a transfer paper, the remaining toners on the drum are recovered by cleaning to reuse.

As the cleaning method of the remaining toners on the drum, a method of contacting a cleaning blade composed of a rubber material such as a urethane rubber, etc., onto the surface of the photosensitive drum is generally used. In such a blade cleaning method, as a matter of course, an inferior cleaning for insufficiently removing the remaining toners must be prevented and furthermore, the cleaning blade must be designed to prevent the occurrence of troubles such as an abnormal sound (sliding sound) of the cleaning blade, turning of the blade, etc.

Now, as the evaluation of the cleaning results, there are not only the evaluation of the cleaning property during ordinary use but also the problem occurred at initially rotating the photosensitive drum by contacting thereto the cleaning blade.

That is, in the initial state, toners do not exist on the surface of the photosensitive drum and hence the cleaning blade is directly contacted with the photosensitive drum, whereby the friction resistance is very high. When the photosensitive drum is rotated in such a state, it sometimes happens that the surface of the photosensitive drum and the edge of the cleaning blade are damaged by the friction and also the rotation of the drum becomes impossible due to the cleaning blade.

Hitherto, for preventing the occurrence of such problems, a method of attaching a proper lubricant powder to the photosensitive drum and/or the cleaning blade is first practiced. Such a lubricant powder is called as a cleaning assistant, or a cleaning aid, and a powder of TEFLON or polyvinylydene fluoride (KAINER, trade name, made by Penwalt Co.) has been used.

However, it has been found that when the photosensitive drum is rotated using the conventional cleaning assistant as described above, the cleaning assistant itself is strongly negatively charged, which results in causing the problem that the surface of the photosensitive drum is positively charged. When an organic photosensitive drum (hereinafter, such is referred to as an OPC drum), which is negatively charged, is used as the photosensitive drum, the positive charge is not discharged. As a result, the positive charge remains on the surface of the photosensitive drum for a long time to cause a defect in the image formation. This phenomenon is called a charge memory and in the case of using a packaging material for the photosensitive drum, it is required to use a packaging material causing the frictional charge having the same polarity as the charging polarity of the photosensitive drum as described in JP-A- 64-70785 (the term "JP-A" as used herein means an "unexamined published Japanese patent application"). This shall be the same in the case of the cleaning assistant.

SUMMARY OF THE INVENTION

The object of the invention is to solve the problems in the conventional techniques described above and to provide a photosensitive drum unit of an electrophotographic apparatus attached with the cleaning assistant which does not cause an image defect on the photosensitive drum by the charge memory even when cleaning of the photosensitive drum is carried out using the cleaning assistant.

As the result of various investigations for attaining the above-described objects, the inventors have discovered that in the case of rubbing the photosensitive layer of a photosensitive drum, when the frictionally charged potential of the photosensitive drum is not higher than 100 V, the defect at the image formation caused by the so-called charge memory does not substantially occur and have accomplished the invention based on the discovery.

That is, according to an aspect of the invention, there is provided a photosensitive drum unit having attached to the surface of the photosensitive drum of an electrophotographic apparatus and/or a cleaning blade, a cleaning assistant composed of a lubricant capable of lowering the frictionally charged potential of the photosensitive drum by the friction of the photosensitive drum and a cleaning blade to not higher than 100 V.

DETAILED DESCRIPTION OF THE INVENTION

Figure 1:
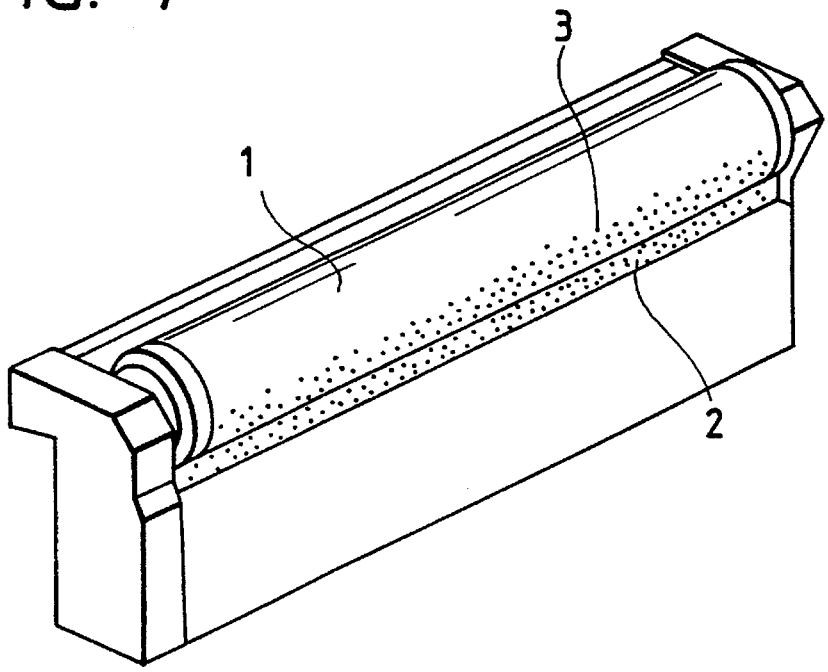
FIG. 1 is a slant view showing an example of the photosensitive drum unit of the invention.

In the invention, as the cleaning assistant, a lubricant capable of lowering the frictionally charged potential of the surface of the photosensitive drum by the friction of the photosensitive drum and a cleaning blade to not higher than 100 V is used. If the frictionally charged potential of the surface of the photosensitive drum becomes higher than 100 V, a positive charge memory remains on the photosensitive drum. Hence the lubricant being used is required to lower the frictionally charged potential of the surface of the photosensitive drum to not higher than 100 V.

As the lubricant being used in the invention, a lubricant capable of lowering the frictionally charged potential of the surface of the drum by the friction of the photosensitive drum and a cleaning blade to not higher than 100 V, and preferably from 5 V to 100 V may be used. Preferred examples of the lubricant are an alkylenebisstearylamide, such as ethylenebisstearylamide, isobutylenebisstearylamide, etc.; a polymethacrylic acid ester, such as polymethyl methacrylate, etc.; and a fatty acid metal salt, such as zinc stearate, etc. In these materials, the alkylenebisstearylamide and the polymethacrylic acid ester are preferred, and the alkylenebisstearylamide and polymethyl methacrylate are particularly preferably used. Also, lubricants other than those described above, if the frictionally charged potential of the surface of the photosensitive drum is not higher than 100 V when the dispersion of the lubricant dispersed in a liquid dispersion medium is applied to the surface of the photosensitive drum or the cleaning blade, can be used in the invention.

On the other hand, in the case of the conventionally used materials containing a fluorine atom, such as polyvinylidene fluoride and TEFLON, the frictionally charged potential becomes higher than the foregoing value and hence these materials can not be used as the lubricant in this invention. It is considered that these materials have a high electric negativity and are strongly negatively charged at frictional charging, which results in increasing the positive charge on the photosensitive drum.

In the invention, the mean particle size of the lubricant is preferably in the range of from 0.02 to 2.0 μm.

As the photosensitive drum, the cleaning property of which is improved by the cleaning assistant of the invention, a negatively charging OPC drum having a charge transport layer on the surface thereof is used. In particular, a photosensitive drum having thereon a layer containing a polycarbonate resin is preferably used.

To such an OPC drum, after usually negatively charging, the steps of an image exposure, development, transfer, etc., are repeatedly executed. When a positive charge is applied, the positive charge remains without being discharged as a memory until negative charging is applied.

The charge transport layer is formed by using a mixture of a charge transport material composed of a compound, such as hydrazone, pyrazoline, benzidine, triphenylamine, stilbene, etc., and a binder resin such as polycarbonate, polymethacrylic acid ester, polyarylate, polystyrene, etc. As the binder resin, a polycarbonate resin is preferred.

As a method of attaching the cleaning assistant of the present invention to the surface of the photosensitive drum and/or the cleaning blade, any method may be employed. For example, the cleaning assistant may be simply spread thereto but a method of placing the cleaning assistant in a cloth bag having fine meshes and rubbing or hitting them with the bag or a method of spraying the cleaning assistant with air can be also employed. In the case of spraying the cleaning assistant, a method of electrostatic coating by applying static electricity is preferred for preventing scattering of the cleaning assistant. Also, a method of coating a dispersion of the cleaning assistant in a liquid dispersion medium is preferred in practice because the cleaning assistant can be uniformly attached without producing a scattering of the powder to provide a higher construction rate thereby facilitating a more rapid set up the drum unit.

For the liquid dispersion medium being used, it is required that the dispersion medium does not dissolve the surface of the OPC drum and does not permeate into the drum surface. As such a dispersion medium, water is a typical medium although the cleaning assistant is reluctant to disperse in water, a liquid fluorine-containing hydrocarbon shown by general formula $C_nF_{n+2}$ (wherein n is an integer of from 4 to 10) can be preferably used. Since the liquid fluorine containing hydrocarbon is completely inactive to the surface of the OPC drum and it does not form a volatile residue, the hydrocarbon does not reduce the electric characteristics of the OPC drum.

As a means for dispersing the cleaning assistant in the liquid dispersion medium, an ordinary dispersing apparatus for coating materials, such as a ball mill, a sand mill, a homogenizer, an ultrasonic dispersing apparatus, a paint shaker, etc., can be used. The dispersed concentration of the cleaning assistant is preferably in the range of from 2 to 20% by weight to the dispersion medium and the concentration thereof may be properly selected according to the coating amount and the workability.

The dispersion obtained as described above is coated on the surface of the photosensitive drum and/or the surface of the cleaning blade by an appropriate means and spontaneously drying the dispersion medium, to attach the cleaning assistant to the surfaces of them.

Example

As an example of the method of using the lubricant as the cleaning assistant of the invention, the lubricant may be used for a photosensitive drum unit mounted on an electrophotographic apparatus. A photosensitive drum unit has at least a photosensitive drum 1, a cleaning blade 2, and a recovered toner containing box, etc., as shown in FIG. 1. If necessary, the unit may be integrated with a developing device in a body. When assembling the photosensitive drum unit, with the cleaning assistant 3 attached onto the surface of the photosensitive drum and/or the cleaning blade, the photosensitive drum can be smoothly rotated.

Figure 2:
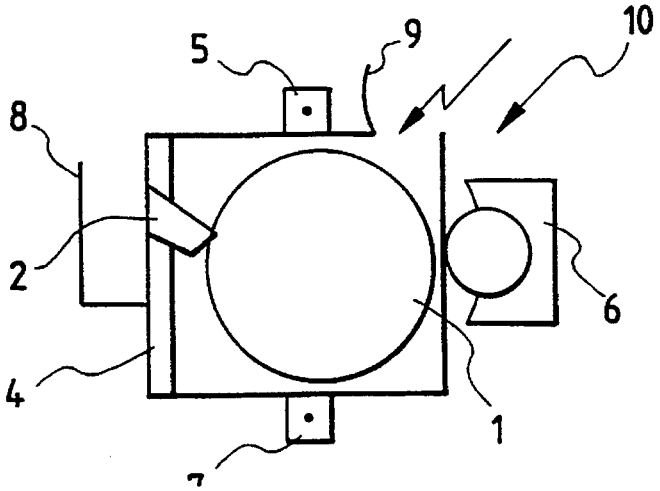
FIG. 2 shows the photosensitive drum unit of the invention assembled in a copying machine.

FIG. 2 shows a photosensitive drum unit 10 of the present invention assembled within a copying machine. In the photosensitive drum unit 10, a photosensitive drum 1 is rotatively set with a rotating shaft (not shown). The rotating shaft is connected to a driving device for the photosensitive drum (not shown). A cleaning blade 2 is positioned using a cleaning blade fixture 4 so that the edge of the cleaning blade 2 contacts the surface of the photosensitive drum 1. The surface of the photosensitive drum 1 assembled in the copying machine is set to face a charging device 5, such as a corotron, a developing device 6, a transfer device 7 and a toner recovery device 8.

The surface of the photosensitive drum is uniformly charged by the charging device 5, and subjected to an imagewise exposure through exposure window 9. The latent image thus prepared on the surface of the photosensitive drum is developed or visualized with toners contained in a developing device 6. The toner image thus obtained is transferred to a transfer material such as a transfer paper by a transfer device 7. Subsequently, remaining toners, which are not transferred from the surface of the photosensitive drum 1, are removed from the surface of the photosensitive drum 1 by the cleaning blade 2 so as to be collected in a recovery device 8 attached to the copying machine.

The steps disclosed above are repeated to provide plural copying operations.

Although a photosensitive drum unit 10 comprising a photosensitive drum 1 and a cleaning blade 2 is herein exemplified, the photosensitive drum unit 10 may further be installed with at least one of a charging device, a developing device, a transfer device and a toner recovery device within the photosensitive drum unit 10.

Figure 3:
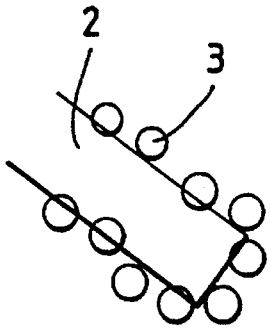
FIG. 3 shows a schematic view of lubricants attached on the surface of the cleaning blade.

FIG. 3 shows a schematic view of lubricant grains (cleaning assistant 3) attached on the surface of the cleaning blade. The lubricant grains may be simply spread on the surface of the photosensitive drum 1, or coated uniformly in the form of a dispersion of the lubricant in a dispersion medium and dried, to produce the state shown in FIG. 3. It is necessary that the lubricant be provided so as to be present at the contact position of the surface of the photosensitive drum 1 and the cleaning blade 2, or to stand between the surface of the photosensitive drum 1 and the cleaning blade 2 prior to rotation of the photosensitive drum 1.

It is sufficient that the lubricant (cleaning assistant 3) of the invention be supplied between the surface of the photosensitive drum and the cleaning blade 2 when assembling the drum unit 10, i.e., when setting the cleaning blade 2 and the photosensitive drum 1. Application of the lubricant between the surface of the photosensitive drum 1 and the cleaning blade 2 when assembling the drum unit 10 exerts a desired effect in the invention. By repeating the image-formation process, lubricant grains are gradually removed or lost. However, the toner grains which are supplied at the developing step work as a lubricant.

It is also effective that toners in which lubricant grains have been added to the toner grains are used. Such results in the lubricant grains being continuously supplied to the cleaning part.

Further, it may be effective that the cleaning assistant 3 is continuously supplied to the contact part between the surface of the photosensitive drum 1 and the cleaning blade 2.

In the photosensitive drum unit 10, it is preferred that after applying the cleaning assistant 3 to the surface of the photosensitive drum 1, the photosensitive drum 1 is rotated more than once so that the cleaning assistant 3 is applied to the whole surface of the photosensitive drum 1.

For determining frictional charging of the cleaning assistant 3 and the photosensitive layer of the photosensitive drum 1, the cleaning assistant 3 is spread onto the surface of the photosensitive layer, then the surface is rubbed with the cleaning blade 2, and the charged potential of the photosensitive drum is measured. In this case, the contacting condition may coincide with the condition being practically used.

Then, using the cleaning assistant 3 composed of various lubricants described below, the charged potentials of the photosensitive drum were measured under the following conditions:

Cleaning Blade:

Polyurethane rubber, thickness 1.5 mm, the contact angle to the photosensitive drum: 20°; the pressure: 50 g per cm of blade.

Photosensitive Drum:

OPC drum comprising a 40 mm diameter aluminum pipe with a charge generating layer containing a chloroindium phthalocyanine pigment and a charge transport layer containing a polycarbonate Z resin and a benzidine compound (see, JP-A-1-257966) formed thereon.

Lubricants constituting the cleaning assistant:

(1) Polyvinylidene fluoride (KAINER 461, trade name, made by Penwalt Co.)

(2) TEFLON (RUBLON L2, trade name, made by Daikin Industries, Co., Ltd.)

(3) Polymethyl methacrylate, (4) Zinc stearate, (5) Ethylenebisstearylamide, (6) Isobutyrenebisstearylamide, and (7) Polyethylene.

The measured results of the frictionally changed potentials are shown in Table 1 below.

TABLE 1

| Lubricant | (1) | (2) | (3) | (4) | (5) | (6) | (7) |
|---|---|---|---|---|---|---|---|
| Potential | 360V | 300V | 50V | 100V | 20V | 20V | 220V |

The photosensitive drums, structured as described above, were mounted on a laser printer (XP-11, trade name, manufactured by Fuji Xerox Co., Ltd.) and the images obtained were compared. The results are shown in Table 2 below.

TABLE 2

| Lubricant | Image |
|---|---|
| (1) | Fog of 0.2 in optical density was generated |
| (2) | Fog of 0.2 in optical density was generated |
| (3) | No problem |
| (4) | No problem |
| (5) | No problem |
| (6) | No problem |
| (7) | Fog of 0.2 in optical density was generated |

The optical densities noted in Table 2 were measured using a Macbeth reflection densitometer.

As shown in the above results, when the frictionally charged potential was 100 V or lower, there was no problem but when the potential was higher than 100 V, fog of 0.2 in optical density was formed. The fog phenomenon occurring by lower of the potential by the positively charged memory.

In addition, when one part of each powder of the foregoing (3) polymethyl methacrylate, (5) ethylenebisstearylamide , and (6) isobubyrenebisstearylamide was added to 20 parts of a liquid fluorine series hydrocarbon: $C_6F_{14}$ (PF5060, trade name, made by Sumitomo 3M Ltd.), dispersing them by a ball mill, and coating a small amount of the resultant mixture on the edge portion of the cleaning blade, the same results as above were obtained. Also, when the cleaning assistant 3 was coated using the liquid fluorine series hydrocarbon, it was advantageous because the cleaning assistant 3 could be coated uniformly as compared with the case of simply spreading the cleaning assistant 3. Thus, the powder was not scattered and lost and the drum unit can be assembled at a high construction rate.

As described above, even when residual toners on the surface of a photosensitive drum are cleaned using the cleaning assistant of the invention, because the frictionally charged potential generated by the friction of the photosensitive drum with the cleaning blade is 100 V or lower, there is no problem of the charge memory becoming a problem at image formation. As a result, the photosensitive drum unit of the invention can form images without causing problems and is industrially very useful.

What is claimed is:

1. A photosensitive drum unit for an electrophotographic apparatus of the type of contacting a cleaning blade to a photosensitive drum, wherein a lubricating layer comprising a cleaning assistant composed of a lubricant capable of lowering the frictionally charged potential of the photosensitive drum caused by the friction of the photosensitive drum and the cleaning blade to less than or equal to 100 V is attached to the surface of the photosensitive drum, the cleaning blade or to both, and the lubricant is powder of an alkylenebisstearylamide or a polymethacrylic acid ester.

2. A photosensitive drum unit for an electrophotographic apparatus of the type of contacting a cleaning blade to a photosensitive drum, wherein a lubricating layer comprising a cleaning assistant composed of a lubricant capable of lowering the frictionally charged potential of the photosensitive drum caused by the friction of the photosensitive drum and the cleaning blade to less than or equal to 100 V is attached to the surface of the photosensitive drum, the cleaning blade or to both, and the surface of the photosensitive drum is composed of a layer containing a polycarbonate resin.

3. A photosensitive drum unit for an electrophotographic apparatus of the type of contacting a cleaning blade to a photosensitive drum, wherein a lubricating layer comprising a cleaning assistant composed of a lubricant capable of lowering the frictionally charged potential of the photosensitive drum caused by the friction of the photosensitive drum and the cleaning blade to less than or equal to 100 V and the cleaning assistant is attached to the surface of the photosensitive drum, the cleaning blade or to both by static electricity.

4. A photosensitive drum unit for an electrophotographic apparatus of the type of contacting a cleaning blade to a photosensitive drum, wherein a lubricating layer comprising a cleaning assistant composed of a lubricant capable of lowering the frictionally charged potential of the photosensitive drum caused by the friction of the photosensitive drum and the cleaning blade to less than or equal to 100 V, the lubricating layer comprises a dispersion formed by dispersing the cleaning assistant in a liquid fluorine-containing hydrocarbon represented by general formula $C_nF_{n+2}$, where n is an integer of from 4 to 10, that is attached to the surface of the photosensitive drum, the cleaning blade or to both.

* * * * *

UNITED STATES PATENT AND TRADEMARK OFFICE

CERTIFICATE OF CORRECTION

PATENT NO. : 5,463,456

DATED : October 31, 1995

INVENTOR(S) : Yuichi Yashiki et al.

It is certified that error appears in the above-indentified patent and that said Letters Patent is hereby corrected as shown below:

On the title page item [75], change "Nakjajima" to --Nakajima--.

Signed and Sealed this

Twenty-third Day of January, 1996

*Attest:*

Bruce Lehman

BRUCE LEHMAN

*Attesting Officer*

*Commissioner of Patents and Trademarks*